US007841151B2

(12) United States Patent
Uhlig

(10) Patent No.: US 7,841,151 B2
(45) Date of Patent: Nov. 30, 2010

(54) EDGE-MOLDING SYSTEM FOR FLOOR COVERINGS

(75) Inventor: Thomas Uhlig, Gettysburg, PA (US)

(73) Assignee: The Matworks Company, LLC, Beltsville, MD (US)

( * ) Notice: Subject to any disclaimer, the term of this patent is extended or adjusted under 35 U.S.C. 154(b) by 346 days.

(21) Appl. No.: 12/008,945

(22) Filed: Jan. 15, 2008

(65) Prior Publication Data

US 2009/0178364 A1 Jul. 16, 2009

(51) Int. Cl.
*E04C 2/38* (2006.01)

(52) U.S. Cl. ..... 52/741.1; 52/717.03; 52/DIG. 13; 428/60

(58) Field of Classification Search ..... 52/DIG. 13, 52/211, 174, 716.1, 717.03, 741.1, 506.05; 428/82, 88, 100, 57, 60, 99; 49/467, 468, 49/469; 404/8, 35, 39; 16/7; 14/69.5
See application file for complete search history.

(56) References Cited

U.S. PATENT DOCUMENTS 1,959,991 A * 5/1934 Vaughan ..... 52/716.1
2,644,977 A * 7/1953 June ..... 16/7
2,875,467 A * 3/1959 De Vault ..... 16/7
3,083,393 A * 4/1963 Nappi ..... 15/215
3,234,577 A * 2/1966 Mann, Jr. ..... 15/217
3,238,554 A * 3/1966 Mann, Jr. ..... 15/217
3,310,919 A * 3/1967 Bue et al. ..... 52/127.11
3,411,977 A * 11/1968 Slater, Jr. ..... 428/33
3,578,738 A * 5/1971 Hughes ..... 15/215
3,862,876 A * 1/1975 Graves ..... 428/83
4,029,834 A * 6/1977 Bartlett ..... 428/62
4,054,698 A * 10/1977 Hamrah ..... 428/41.8
4,353,944 A * 10/1982 Tarui ..... 428/74
4,568,587 A * 2/1986 Balzer ..... 428/52
4,654,245 A * 3/1987 Balzer et al. ..... 428/52
4,804,570 A * 2/1989 Bedics ..... 428/53
4,822,658 A 4/1989 Pacione
4,845,910 A 7/1989 Hanson et al.
5,018,235 A * 5/1991 Stamatiou et al. ..... 15/215
5,082,280 A * 1/1992 Wang ..... 473/181
5,114,774 A * 5/1992 Maxim, Jr. ..... 428/101
5,133,166 A 7/1992 Pacione
5,134,822 A * 8/1992 Edlin ..... 52/273
5,144,786 A 9/1992 Pacione
5,465,546 A * 11/1995 Buse ..... 52/480
5,581,967 A * 12/1996 Glatz ..... 52/465
5,611,181 A * 3/1997 Shreiner et al. ..... 52/396.04
5,666,775 A * 9/1997 Shreiner et al. ..... 52/396.04
5,691,026 A * 11/1997 Zinke et al. ..... 428/100
6,090,462 A 7/2000 Kanter
6,093,469 A * 7/2000 Callas ..... 428/95
6,128,881 A * 10/2000 Bue et al. ..... 52/582.2
6,258,202 B1 * 7/2001 Callas ..... 156/293
6,345,480 B1 * 2/2002 Kemper et al. ..... 52/395

(Continued)

*Primary Examiner*—Robert J Canfield
*Assistant Examiner*—Brent W Herring
(74) *Attorney, Agent, or Firm*—Hodes, Pessin & Katz, P.A.

(57) ABSTRACT

An edge molding providing an edging for a floor covering such as a carpet, rug, tile and the like floor coverings comprising a stepped-molding which attaches to a subfloor edge through a hook and loop means to provide an edge molding for a floor covering which floor covering is attached to the subfloor through a means of a hook and loop arrangement.

1 Claim, 5 Drawing Sheets

U.S. PATENT DOCUMENTS

| | | | | |
|---|---|---|---|---|
| 6,460,303 | B1 * | 10/2002 | Pacione | 52/311.2 |
| 6,505,444 | B1 * | 1/2003 | Johnson | 52/177 |
| 6,572,952 | B1 | 6/2003 | Kanter | |
| 6,802,167 | B2 | 10/2004 | Pacione | |
| 6,966,155 | B2 * | 11/2005 | Nevison | 52/177 |
| 7,194,843 | B2 | 3/2007 | Pacione | |
| 7,597,949 | B2 * | 10/2009 | Wright | 428/116 |
| 2003/0219570 | A1 * | 11/2003 | Kanter | 428/157 |
| 2006/0191218 | A1 | 8/2006 | Pacione | |
| 2007/0204428 | A1 | 9/2007 | Pacione | |
| 2009/0178367 | A1 * | 7/2009 | Barlow | 52/745.13 |

* cited by examiner

EDGE-MOLDING SYSTEM FOR FLOOR COVERINGS

BACKGROUND OF THE INVENTION

There are commercially available large sheets of rigid plastic which are placed on a floor and are interlocked to form a subflooring. The upper surface of these sheets is formed with a plurality of hook-like members (Velcro™). As a companion to these sheets there are provided sections of rug, carpet or panels which have a layer of loop-type material (Velcro™) attached to one side thereof. The rug or carpet is laid out on the subflooring so that the hooks and loops engage to secure the rug or carpet to the subfloor. This arrangement is known commercially. The herein disclosed invention provides an elegant means for adding a utilitarian or decorative molding for said rug or carpet.

The edging of the disclosed invention will be attached using loop fabric to be applied to a system of hook plates loose-layed on the floor. The primary application is edging for solid decorative flooring, so it is critical that the edging does not extend over the top of the removable flooring, or it will create a trip hazard. Advantages will accrue through the use of the inventive edging. For example, the edging will adhere directly to the plate system, ensuring that it does not extend higher than the top floor covering surface; the edging can be removed and replaced along with the floor covering, allowing a change of size, shape, location, or even thicker or thinner flooring top surfaces with minimum time and expense; for wet floor applications, the edging does not have to be glued down. Water coming up through a concrete floor will dissolve adhesives and result in the edging coming loose. The herein disclosed edging avoids the problem encountered by the use of water-dissolved adhesives.

FIELD OF THE INVENTION

The herein disclosed invention finds applicability as a decorative or utilitarian molding to be placed around the outer edge of floor coverings such as rugs, carpets, or tiles. The invention finds particular applicability where Velcro™ is used to fix tiles or carpeting to subflooring.

DESCRIPTION OF RELATED ART

Pacione (U.S. Pat. No. 7,194,843) teaches a flexible anchor sheet used for attaching carpets and is to be used without substantial attaching to the floor.

Pacione (U.S. Pat. No. 6,802,167) discloses an anchor sheet subfloor having a thin flexible rigid sheet material and a bottom layer of a relatively resilient cushioning material.

Kanter (U.S. Pat. No. 6,572,952) teaches a playground carpet with a tapered edge, but the inventive step-shaped molding is not disclosed.

Johnston et al (U.S. Pat. No. 6,475,594) teach a mat assembly for absorbing oil. The mat has removable restraining strips to hold the mat in a planar orientation. The oil-soaked mat can be replaced and the strips reused.

Kanter (U.S. Pat. No. 6,090,462) teaches a carpet with shock-absorbing properties and has a Velcro™-attached molding at the outer perimeter. However, the Kanter molding is not step-shaped.

Pacione (U.S. Pat. No. 5,144,786) teaches an anchor board system for use as cladding, employs hooks and loops, and may have corner-trim; however no step-shaped molding is taught.

Pacione (U.S. Pat. No. 5,133,166) teaches major construction using attachments employing a hook and loop arrangement. No step-shaped molding is disclosed.

None of the prior art herein cited shows the inventive concept of the step-shaped molding.

Closest Prior Art—Maxim, Jr. (U.S. Pat. No. 5,114,774) teaches a hook and loop floor mat system wherein the floor mat is removably attached (because it is used in wet or oily environments). An edge portion (margin) is disclosed. The edge portion is stepped. However, the molding strip of the instant invention is distinct from that of Maxim, Jr. in that the molding of the instant invention attaches fixedly to a subsurface. Note also that inventive border at its bottom aligns with the hook surface of the subfloor for a smooth fit. Further note also that the claims of the Maxim, Jr. patent are focused on the absorbent rather than the border.

Hanson et al (U.S. Pat. No. 4,845,910) is directed to a baseboard molding. No step molding arrangement is shown.

Pacione (2006/0191218) discloses a decorative floor covering.

Kanter (2003/0219570) is similar to Kanter (U.S. Pat. No. 6,572,952) above cited and as discussed above is not seen to be pertinent.

None of the prior art herein cited discloses the herein claimed invention of a stepped arrangement for a carpet molding.

BRIEF SUMMARY OF THE INVENTION

In this patent the expressions rug, carpet, tile and like floor coverings are to be used interchangeably.

The herein disclosed invention is designed to provide a border or edging for a rug, carpet, panel or like floor covering so that the top dimension of the molding will lay substantially even with the top dimension of the rug, carpet or panel and will be tapered away from the carpet to engage the floor smoothly so as to prevent stumbling.

In use a strip of molding is to be placed around the outer periphery of the carpet/subfloor. The molding has a lower surface bottom having a step formed therein. Adjacent to the lower portion of the step, there is attached a strip of loop material (Velcro™) which engages the hook surface (Velcro™) of the subfloor. The upper surface of the molding, which is directly above the strip of loop material, is in the same plane as the upper surface of the rug/carpet. The upper surface of the molding which tapers downwardly away from the carpet will provide a non-trip surface for walking onto the rug/carpet. The bottom portion of the molding beneath the upper tapering surface lies flat on the floor, on a plane even with the bottom surface of the subfloor.

OBJECTS OF THE INVENTION

The main object of this invention is to provide an esthetically pleasing molding for a rug or carpet which is easy to attach to a rug or carpet.

Another object of this invention is to provide a molding which is easy to remove and replace.

A further object is to provide a decorative molding for rug or carpet edging.

A still further object of the invention is to provide an edge-molding for a carpet which will allow an easy, non-trip access from the molding to the carpet.

These and other objects of the present invention will become apparent from a reading of the following specification taken in conjunction with the enclosed drawings.

DESCRIPTION OF THE INVENTION

Figure 1:
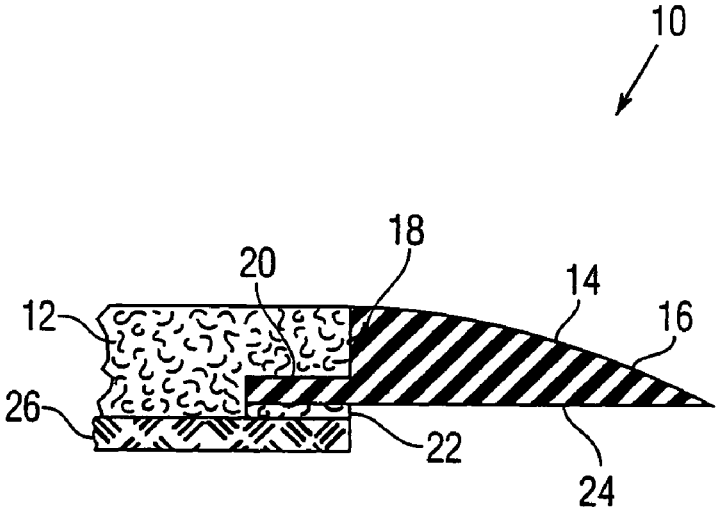
Prior Art Fig. 1
FIGS. 1 and 2 are figures showing prior art carpet edge moldings.
Figure 2:
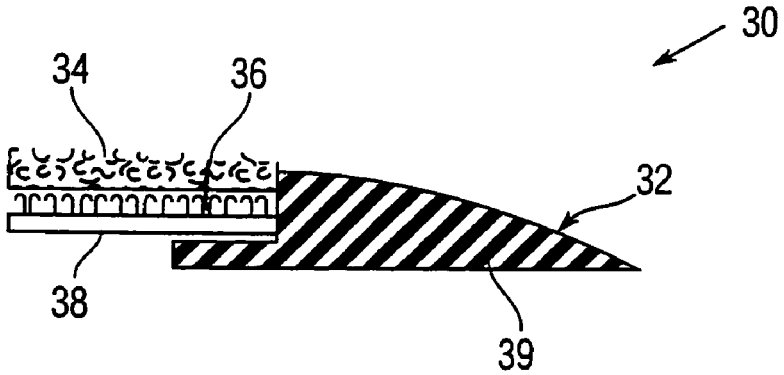
Prior Art Fig. 2

FIGS. 1 and 2 describe the prior art which is directed to a floor mat system 10 wherein the floor mat is removably attached to a floor; with the mat arrangement allowing for the use of the floor by pedestrians under wet or oily conditions. More specifically, FIG. 1 illustrates a cross-section of edging portion 14 which includes a beveled portion 16 and a grooved portion 18 running the length of the edging portion 14. The beveled portion 16 permits the edge of the mat to drape more desirably over the floor and prevents tripping on the edge of the mat. The grooved portion 18 contains the skid-free upper surface 12 which is attached at 20 to the edging portion 14 by any suitable attachment means such as by adhesives. The edging portion 14 and upper surface 12 are able to be removed from the removable portion 26 and can be positioned below the upper surface 12 next to the floor. The edging portion 14 includes base surface 24 to which is attached self-gripping fastener 22.

FIG. 2 illustrates another embodiment of the prior art 30 wherein a section of a floor mat 32 is depicted with a fiber-containing removable portion 34 bound by an edging portion 39 and is removably attached to self-gripping fastener means 36, which are attached to a base portion 38 beneath the fiber-containing removable portion 34. The base layer 38 may be fabricated with ribs to further encourage welling liquid away from the fiber-containing removable portion 34.

The disclosed and claimed invention is not shown by the prior art.

Figure 3:
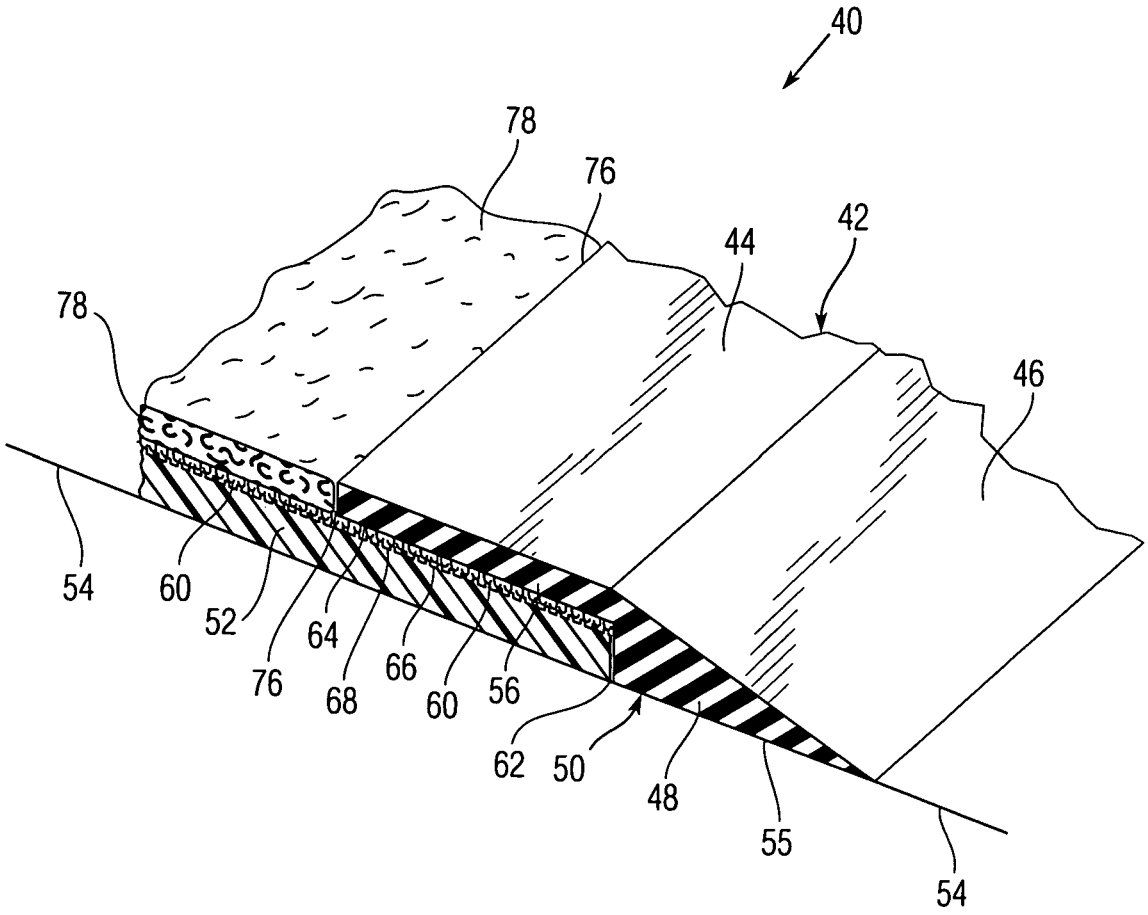
FIG. 3 is a perspective view of the carpet edge molding system with a portion thereof cut-away to show detail.
Figure 4:
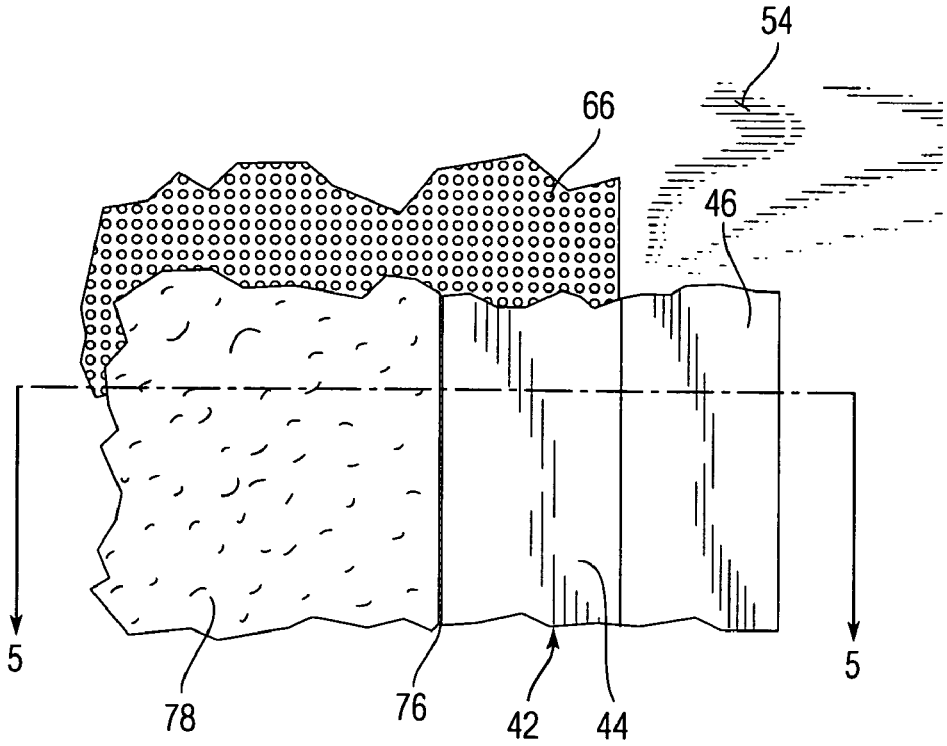
FIG. 4 is a top plan view thereof.
Figure 5:
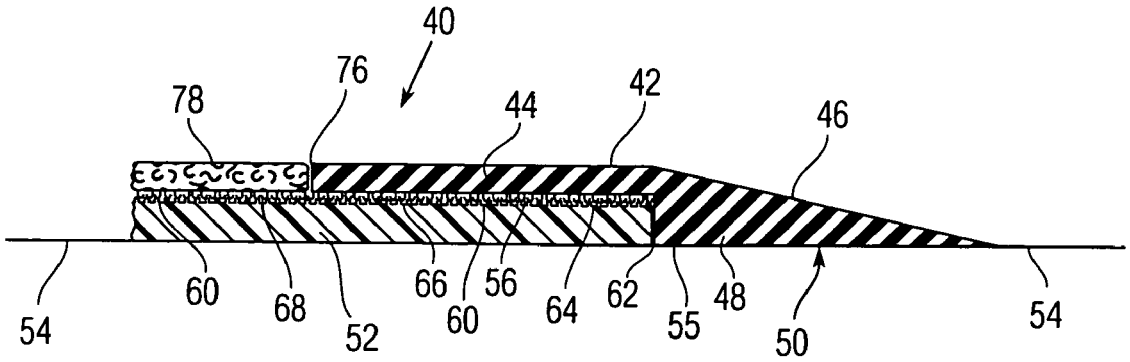
FIG. 5 is a cross-section view taken along lines 5-5 of FIG. 4.

With regard to FIGS. 3-5, a floor cover edging system 40 has a molding 42 having a flat top 44 which tapers away to the side 46, with the bottom 48 of said molding 42 having a flat first step 50 under the flat top which tapers away 46 and is positioned over the floor 54 and a second flat step 56 adjacent to the first step 50 and is to be positioned over a subfloor 52 and is secured to the subfloor 52 by a hook and loop arrangement 60 and such that the flat first step 50 registers smoothly 55 with the floor 54 and the edge of the subfloor 62 and the second flat step 64 registers smoothly 68 with the top of the subfloor 66 and secured by a hook and loop arrangement 60 and registers with the edge of a floor covering 76; and such that a neat and attractive edging is made for the floor covering 78.

Figure 6:
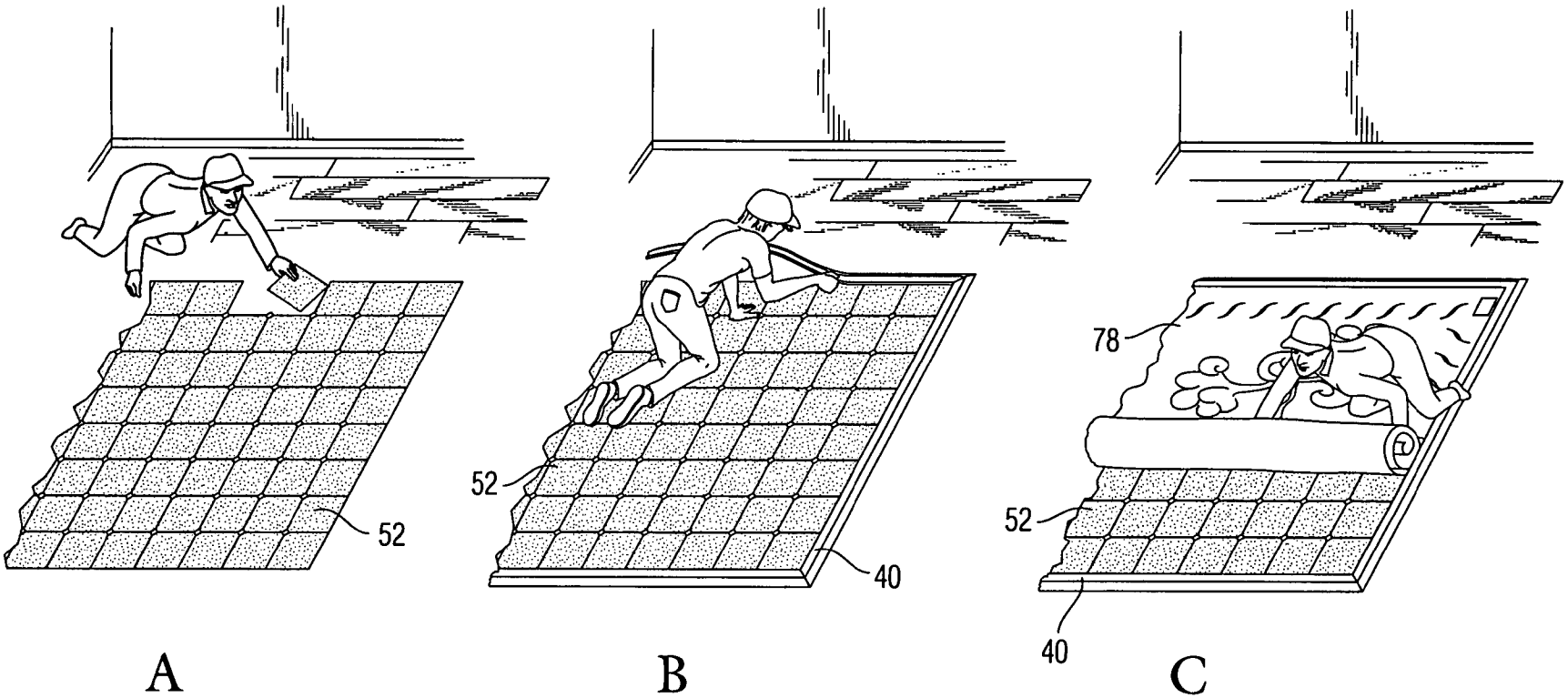
FIGS. 6-A, 6B and 6C are a series views showing the ease with which a molding and a floor covering can be installed in a room.
Figure 7:
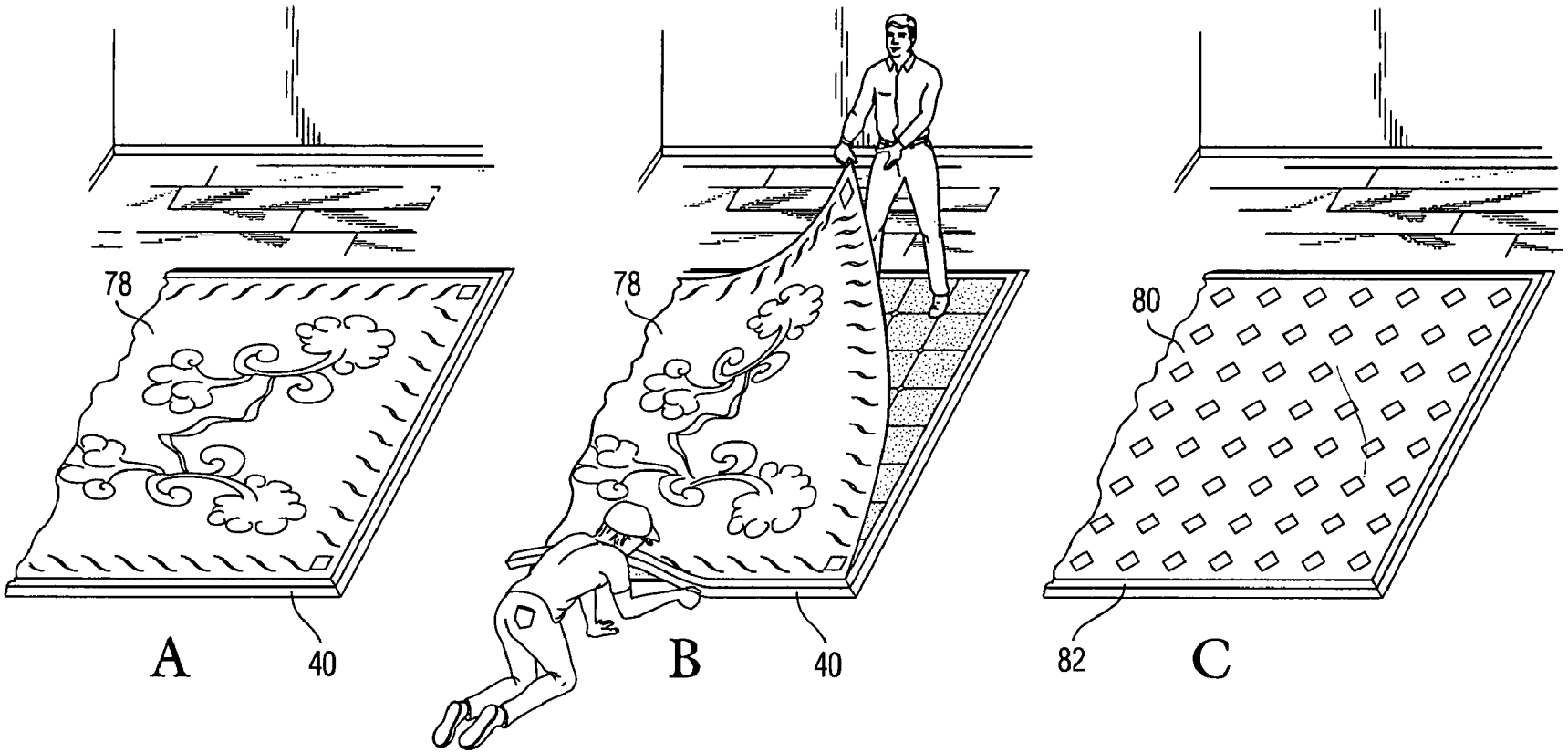
FIGS. 7A, 7B and 7C are a series of views showing the ease with which an old floor covering can be removed and replaced by a new floor covering and a new molding.

With reference to FIGS. 6 and 7 there are views depicting the ease with which the molding can be applied to the flooring and carpeting systems; and also the ease with which the carpet and molding can be replaced. FIG. 6A shows the subflooring 52 being laid. FIG. 6B shows the molding 40 being applied to the edge of the subfloor 52. As shown in FIG. 6C, once the subfloor 52 and edge molding 40 are applied the floor covering 78 can be applied. In FIG. 7A there is illustrated the old carpet 78 in place; in FIG. 7B the workman can remove the old carpet and also lift the molding and replace the old carpet and molding with a new carpet 80 and new molding 82.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A method for providing a floor covering with an edge molding comprising:

providing a subfloor with a loop surface;

attaching a molding along the edge of said subfloor by the use of a hook edge to join the hook-edge molding to the loop surface subfloor, the molding having a flat top which tapers away to the side, with the bottom of said molding having a flat first step under the flat top which tapers away and being able to be positioned over the floor, and a second flat step adjacent to the first flat step to be positioned over the subfloor and secured to the subfloor by the hook and loop arrangement, such that the flat first step will register smoothly with the floor and the edge of the subfloor and the second flat step will register smoothly with the top of the subfloor and is to be secured by the hook and loop arrangement and will also register smoothly with the edge of the floor covering, such that a neat and attractive edging is made for the floor covering;

then applying the floor covering with the hook surface to the sloop surface subfloor so that the edge molding is in registry with the edge of the floor covering to provide a smooth and neat edge molding for said floor covering.

* * * * *